US005119511A

United States Patent [19]

Packer et al.

[11] Patent Number: 5,119,511

[45] Date of Patent: Jun. 9, 1992

[54] SWIMSUIT WITH BUST CONTROL

[76] Inventors: Jack W. Packer; Shirley G. Packer, both of 16425 Collins Ave., Apt. 1118, Miami Beach, Fla. 33160

[21] Appl. No.: 739,420

[22] Filed: Aug. 2, 1991

[51] Int. Cl.[5] ..... A41D 7/00; A41C 3/08

[52] U.S. Cl. ..... 2/67; 2/73; 450/30; 450/31; 450/66; 450/67; 450/68; 450/69; 450/80; 450/83

[58] Field of Search ..... 2/67, 73, 78 A, 78 C, 2/78 D, 109, 110; 450/30, 31, 32, 33, 34, 66, 67, 68, 69, 80, 83, 85

[56] References Cited

U.S. PATENT DOCUMENTS

| | | | |
|---|---|---|---|
| 1,179,137 | 4/1916 | Orr | 450/69 |
| 1,566,267 | 12/1925 | Bee | 2/73 X |
| 1,587,672 | 6/1926 | Nightingale | 450/30 |
| 1,632,137 | 6/1927 | Jackson | 450/32 |
| 1,813,389 | 7/1931 | Duff | 2/275 |
| 1,844,888 | 2/1932 | Lorenz | 450/31 |
| 2,180,180 | 11/1939 | Versoy | 450/68 |
| 2,313,811 | 3/1943 | Dubner | 450/68 |
| 2,520,225 | 8/1950 | Scott-Elliott | 450/67 |
| 2,536,222 | 1/1951 | Reid | 2/67 |
| 2,612,642 | 10/1952 | Robins | 2/67 X |
| 2,700,160 | 1/1955 | Scholfield | 450/31 |
| 2,712,132 | 7/1955 | Mosen et al. | 2/67 |
| 3,098,485 | 7/1963 | Howell | 128/455 |
| 3,204,638 | 9/1965 | Winkler | 450/80 X |
| 3,255,754 | 6/1966 | Brumberger | 2/67 X |
| 4,398,538 | 8/1983 | Johnson | 2/67 X |
| 4,440,174 | 4/1984 | Cordova | 2/67 X |
| 4,564,015 | 1/1986 | Friedman | 2/67 X |
| 4,955,846 | 9/1990 | Greenberg | 2/73 X |
| 4,956,878 | 9/1990 | Boynton | 2/67 |
| 5,033,986 | 7/1991 | Feigenbaum et al. | 2/67 X |

FOREIGN PATENT DOCUMENTS

| | | | |
|---|---|---|---|
| 0411587 | 3/1925 | Fed. Rep. of Germany | 450/32 |
| 987179 | 8/1951 | France | 2/67 |
| 1014291 | 8/1952 | France | 450/69 |
| 1580222 | 9/1969 | France | 2/67 |

*Primary Examiner*—Werner H. Schroeder
*Assistant Examiner*—Jeanette E. Chapman
*Attorney, Agent, or Firm*—Alvin S. Blum

[57] ABSTRACT

An inner bust control portion of a swimsuit includes an elasticized fabric band that completely encircles the chest. A stretchy elastic horizontal strip is attached at its upper margin, and another at its lower margin, so that the band is pulled up against the chest. Two vertical elastic strips, one at the side of each breast extends from upper to lower horizontal elastic strips. At least one midline vertical elastic strip separates the breasts so that pockets are formed within the fabric band bounded by the elastic strips. The upper margin of the inner bust control portion is attached to the upper margin of the outer fabric of the swimsuit. In an alternative embodiment of the invention, the midline vertical elastic strip or strips are replaced by a drawstring.

4 Claims, 1 Drawing Sheet

SWIMSUIT WITH BUST CONTROL

BACKGROUND OF THE INVENTION

The present invention relates to swimsuits and more particularly to swimsuits for women that incorporate simple and effective means for bust control.

It is common practice in the manufacture of swimsuits to incorporate brassiere cups or what is in effect a substantially complete brassiere therein, such as taught in U.S. Pat. Nos. 2,612,642 issued Oct. 7, 1952 to Robins and 2,700,160 issued Jan. 25, 1985 to Scholfield. This structure is expensive to manufacture and it is confining while swimming.

SUMMARY OF THE INVENTION

It is, accordingly, an object of the invention to provide a swimsuit with a means to hold the bust in place that is inexpensive to manufacture, that is comfortable to wear for various figures, both large and small, firm and flaccid, that is well concealed and that does not interfere with freedom of movement, such as swimming.

The swimsuit of the invention includes a broad elasticized fabric band that encircles the body at the bust. Horizontal elastic strips are attached to the upper and lower edges of the fabric band, and the upper elastic strip is attached to the upper edge of the swimsuit. Three vertical elastic strips connect the upper and lower horizontal elastic strips. A central vertical strip is located at the midline and cooperates with two lateral vertical strips to define two breast pockets in the elasticized fabric band without any special shaping of cups. The lateral vertical strips restrain the breasts from falling to the side without undue constriction by virtue of their yielding nature in combination with the elasticized fabric band, while one or more central vertical strips ensure adequate separation of the breasts.

In an alternative embodiment, the central vertical elastic strip is replaced by a drawstring arrangement to apply tension between upper and lower horizontal elastic strips. The drawstring provides adjustment of the tension.

These and other objects, advantages and features of the invention will become more apparent when the detailed description is read in conjunction with the appended drawings.

DETAILED DESCRIPTION OF PREFERRED EMBODIMENT

Figure 1:
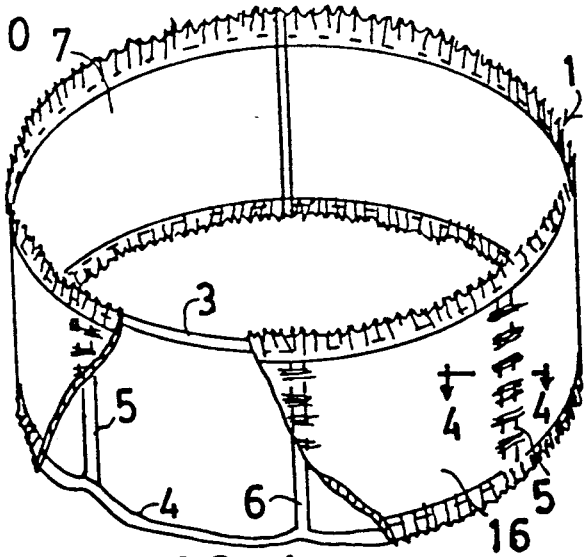
FIG. 1 shows a bust control portion of the swimsuit in perspective view with a portion of the fabric broken away.

Referring now first to FIG. 1, a bust control portion 1 of the swimsuit comprises a circumferential 7 band of knitted, elasticized fabric such as spandex, arranged to encircle the body at the bust. Circumferential horizontal elastic strips 3 and 4 are attached to the upper and lower edges of the band respectively so as to pull the band against the chest. Three vertical elastic strips, a midline strip 6 and two side strips 5 are attached to band 7 and extend from top strip 3 to bottom strip 4, thereby forming yieldable pockets 16 in the soft stretchy fabric of band 7 to hold the breasts in position. The stretchy nature of both the elastic strips and the elastic fabric provide a soft and comfortable fit that can expand to fit any size bust with good control in an inexpensive and comfortable structure.

Figure 2:
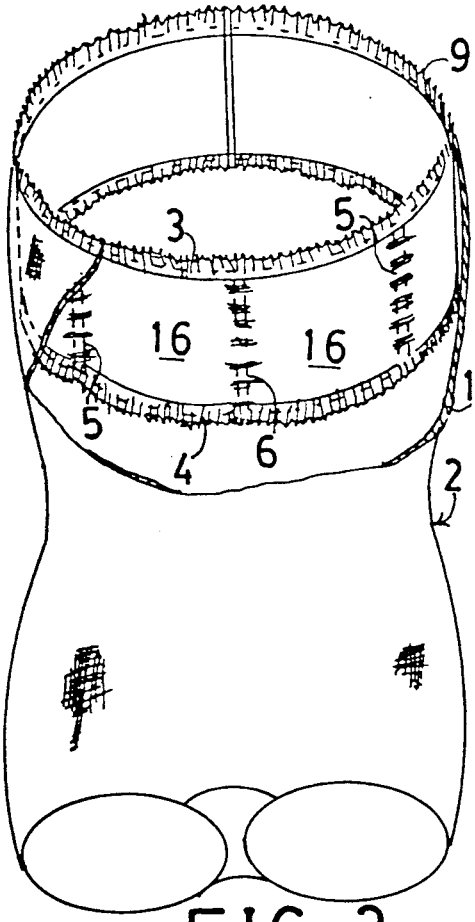
FIG. 2 shows the swimsuit of the invention in perspective view with a portion of the outer fabric broken away to reveal the bust control portion.

Referring now to FIG. 2, the bust control portion 1 is connected at tis upper margin to the upper margin of the outer fabric 10 of the swimsuit. The upper hem of the outer fabric 10 may combine the upper edges of the band 7 and the horizontal elastic strip 3 in various fashions well known in the art. The lower edge 4 of the bust control portion 1 is generally on attached to the outer fabric 10 to provide freedom of movement.

Figure 4A:
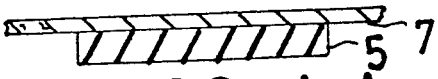
FIG. 4A is an enlarged sectional view through line 4—4 of FIG. 1 showing details of vertical elastic strip structure.

The elastic strips are of the stretchy, rubbery type well known in the garment industry and may be attached by means well known in the art such as by stitching directly to the fabric shirring as illustrated in FIG. 4A.

Figure 4B:
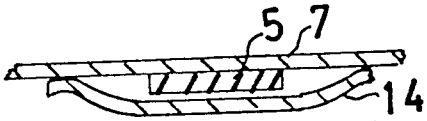
FIG. 4B is an enlarged sectional view through line 4—4 of FIG. 1 showing another embodiment of vertical elastic strip structure.
Figure 4C:
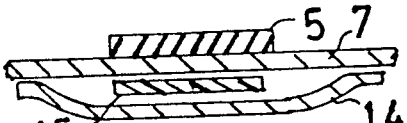
FIG. 4C is an enlarged sectional view through line 4—4 of FIG. 1 showing yet another embodiment of elastic strip structure.

A thick fabric tape 14 may be included to add strength as shown in FIG. 4B. Alternatively, some sort of stiffener such as the bone 15 shown in FIG. 4C may be incorporated into the structure.

Figure 3:
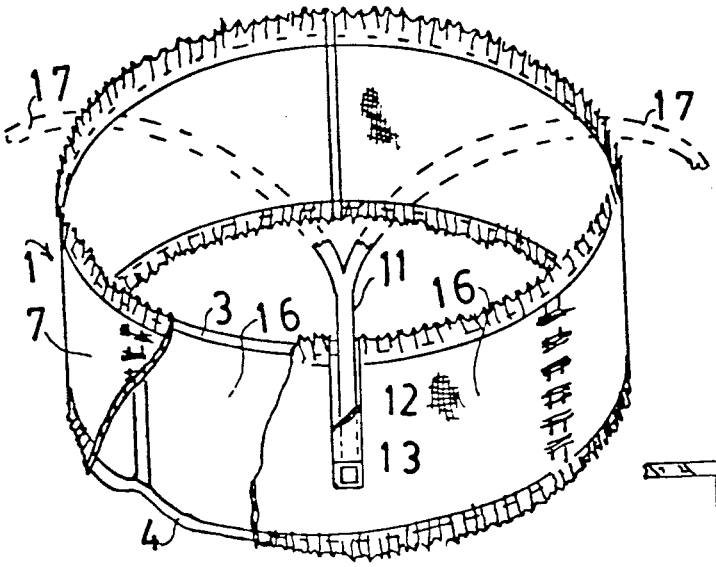
FIG. 3 is a perspective view of an alternative embodiment of the bust control portion of the swimsuit with adjustable central vertical member.

In the alternative embodiment illustrated in FIG. 3, the midline vertical elastic strip has been replaced by an adjustable drawstring 11, that fits into placket 12. It is anchored or tacked at one end 13 and the other end bifurcates to straps 17 that tie around the neck. This allows for some adjustment of tension at the midline and different styling.

The above disclosed invention has a number of particular features which should preferably be employed in combination although each is useful separately without departure from the scope of the invention. While we have shown and described the preferred embodiments of our invention, it will be understood that the invention may be embodied otherwise that as herein specifically illustrated or described, and that certain changes in the form and arrangement of parts and the specific manner of practicing the invention may be made within the underlying idea or principles of the invention within the scope of the appended claims.

We claim:

1. A combination garment comprising:

A) a body-enclosing outer garment having an upper edge encircling a body of a wearer in a chest region;

B) a bust-controlling inner garment including:

1) an elasticized fabric band encircling the body of the wearer in the chest region and covering the breasts of the wearer, said band having an upper and lower edge;

2) a first stretchy elastic horizontal strip attached circumferentially to the upper edge of said band for encircling the chest of the wearer and for providing a circumferential contracting force thereon, and said upper edges of said inner and outer garments being attached to one another and to said strip;

3) a second stretchy elastic horizontal strip attached circumferentially to the lower edge of said band, said lower edge being unattached to said outer garment;

4) two stretchy elastic vertical side strips connected to, and extending between said first and second horizontal strips, said side strips arranged one on each side of said inner garment and adapted to lie one on each lateral side of a breast;

5) at least one stretchy elastic vertical midline strip connected to, and extending between said first and second horizontal strips, said midline strip fitting between the breasts;

whereby said elastic strips are pulling said fabric band against the chest to thereby form breast-receiving pockets therein for the breasts with each pocket bounded by said elastic strips.

2. The garment according to claim 1 in the form of a bathing garment.

3. A combination garment comprising:

A) a body-enclosing outer garment having an upper edge encircling a body of a wearer in a chest region;

B) a bust-controlling inner garment including:

1) an elasticized fabric band encircling the body of the wearer in the chest region and covering the breasts of the wearer, said band having an upper and lower edge;

2) a first stretchy elastic horizontal strip attached circumferentially to the upper edge of said band for encircling the chest of the wearer and for providing a circumferential contracting force thereon, and said upper edges of said inner and outer garments being attached to one another and to said strip;

3) a second stretchy elastic horizontal strip attached circumferentially to the lower edge of said band, said lower edge being unattached to said outer garment;

4) two stretchy elastic vertical side strips connected to, and extending between said first and second horizontal strips, said side strips arranged one on each side of said inner garment and adapted to lie one on each lateral side of a breast;

5) a vertical midline drawstring means arranged anteriorly and midway between said vertical side strips for exerting adjustable upward tension on said band said drawstring means fitting between the breasts to provide separation thereto;

whereby said elastic strips are pulling said fabric band against the chest to thereby form breast-receiving pockets therein for the breasts with each pocket bounded by said elastic strips on three sides and medially by said drawstring means.

4. The garment according to claim 3 in the form of a bathing garment.

* * * * *